US009633809B2

(12) United States Patent
Oh

(10) Patent No.: US 9,633,809 B2
(45) Date of Patent: Apr. 25, 2017

(54) TRIP DEVICE FOR CIRCUIT BREAKER

(71) Applicant: LSIS CO., LTD., Anyang-si, Gyeonggi-do (KR)

(72) Inventor: Kyung Hwan Oh, Gyeongsangbuk-do (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/533,965

(22) Filed: Nov. 5, 2014

(65) Prior Publication Data

US 2015/0179376 A1 Jun. 25, 2015

(30) Foreign Application Priority Data

Dec. 19, 2013 (KR) ..... 10-2013-0159511

(51) Int. Cl.
*H01H 37/52* (2006.01)
*H01H 37/64* (2006.01)
(Continued)

(52) U.S. Cl.
CPC ..... *H01H 37/52* (2013.01); *H01H 37/64* (2013.01); *H01H 71/16* (2013.01);
(Continued)

(58) Field of Classification Search
CPC .... H01H 37/52; H01H 37/64; H01H 71/7427; H01H 71/16; H01H 71/164; H01H 73/22
(Continued)

(56) References Cited

U.S. PATENT DOCUMENTS 2,122,693 A 7/1938 Olav
2,343,132 A 2/1944 Barr
(Continued)

FOREIGN PATENT DOCUMENTS

CN 2660678 12/2004
EP 2204833 7/2010
(Continued)

OTHER PUBLICATIONS

European Patent Office Application Serial No. 14192050.4, Search Report dated May 18, 2015, 7 pages.
(Continued)

*Primary Examiner* — Jerry Wu
*Assistant Examiner* — Stephen Sul
(74) *Attorney, Agent, or Firm* — Lee, Hong, Degerman, Kang & Waimey

(57) ABSTRACT

A trip device for a circuit breaker comprises a first terminal; a second terminal; and a bimetal in which a slot with one side opened is formed at one end of the bimetal, the one end is divided into a first end portion and a second end portion, the first end portion is connected to the first terminal, and the second end portion is connected to the second terminal, wherein the bimetal generates heat with a current which flows between the first end portion and the second end portion, and a heating amount of the bimetal is changed based on a length of the slot. Accordingly, a desired rated current can be set, the bimetal can be prevented from being damaged by a fault current, and the fault current can be effectively detected by obtaining a sufficient amount of heat and a bending amount of the bimetal.

9 Claims, 8 Drawing Sheets

(51) Int. Cl.
*H01H 71/16* (2006.01)
*H01H 71/74* (2006.01)
*H01H 73/22* (2006.01)

(52) U.S. Cl.
CPC ..... *H01H 71/7427* (2013.01); *H01H 71/164* (2013.01); *H01H 73/22* (2013.01)

(58) Field of Classification Search
USPC ..... 337/85, 16, 27, 75, 101, 111, 333, 359, 337/362, 379
See application file for complete search history.

(56) References Cited

U.S. PATENT DOCUMENTS 2,545,402 A 3/1951 Wood
2,748,320 A 5/1956 Ryan
3,697,915 A * 10/1972 Brassard ..... H01H 71/7436 337/101
3,983,454 A 9/1976 Cotton et al.
4,617,545 A 10/1986 Link
5,497,286 A * 3/1996 Shimada ..... H01H 81/02 337/102
5,894,260 A * 4/1999 Cella ..... H01H 71/16 337/3
6,215,379 B1 * 4/2001 O'Keefe ..... H01H 71/164 335/172
9,378,916 B2 * 6/2016 Turner ..... H01H 71/164
2010/0164676 A1 * 7/2010 Jun ..... H01H 71/164 337/77
2014/0232510 A1 * 8/2014 Alcantara ..... H01H 5/18 337/55

FOREIGN PATENT DOCUMENTS

JP 62-136047 8/1987
JP 11-111147 4/1999
KR 10-2010-0080206 7/2010

OTHER PUBLICATIONS

Korean Intellectual Property Office Application Serial No. 10-2013-0159511, Notice of Allowance dated May 28, 2015, 2 pages.
Japan Patent Office Application Serial No. 2014-245752, Office Action dated Oct. 27, 2015, 3 pages.
Korean Intellectual Property Office Application Serial No. 10-2013-0159511, Office Action dated Nov. 13, 2014, 4 pages.
Office Action issued in Chinese patent application No. 201410789844.9, May 30, 2016, 6 pages.

* cited by examiner

TRIP DEVICE FOR CIRCUIT BREAKER

CROSS-REFERENCE TO RELATED APPLICATION

Pursuant to 35 U.S.C. §119(a), this application claims the benefit of earlier filing date and right of priority to Korean Application No. 10-2013-0159511, filed on Dec. 19, 2013, the contents of which is incorporated by reference herein in its entirety.

BACKGROUND OF THE DISCLOSURE

1. Field of the Disclosure

The present disclosure relates to a trip device for a circuit breaker, and particularly, to a trip device using a bimetal as a trip element.

2. Background of the Disclosure

Generally, molded case breaker circuits are a type of electronic device that manually switches on or off an electric circuit by using a handle, or when a fault current such as a short circuit current occurs, detects the fault current to automatically break the electric circuit, thereby protecting a load device and the electric circuit.

FIG. 1 is a cross-sectional view illustrating a related art circuit breaker. FIG. 2 is a perspective view illustrating an indirect trip device of FIG. 1. FIG. 3 is a perspective view illustrating a related art direct trip device for a circuit breaker.

As illustrated in FIGS. 1 to 3, a related art circuit breaker includes a case 10, a fixed contact 20 that is fixedly disposed at the case 10, a moving contact 30 that is disposed to be contactable with and detachable from the fixed contact 20, a switching mechanism 40 that switches on or off the moving contact 30, and an instant trip device 60 that, when a fault current such as a short circuit current occurs, detects the fault current and automatically triggers the switching mechanism 40 in order for the switching mechanism 40 to move to a tripping position within a momentary time. The switching mechanism 40 includes a handle 50 for manually switching on or off the switching mechanism 40 and a crossbar 42 that performs a function (a trigger function) of binding a latch (not shown) of the switching mechanism 40 and releasing the binding of the latch when a below-described bimetal 62 is bent.

Generally, trip devices are categorized into direct trip devices, which directly generate heat with a current flowing in a bimetal, and indirect trip devices which are heated by a heater which is a separate heat generating member. The trip device of FIG. 1 is the indirect trip device 60. The indirect trip device 60, as illustrated in FIG. 2, includes a first terminal 66 which is connected to a power source circuit or a load circuit at one side of the first terminal 66 and is connected to a heater 64*b* of a below-described second terminal 64 at the other side, the second terminal 64 which is connected to the power source circuit or the load circuit at one side of the second terminal 64 and is connected to the first terminal 66 through the heater 64*b* at the other side, and the bimetal 62 which is coupled to the second terminal 64 to be opposite to the heater 64*b*. The bimetal 62 is heated by the heater 64*b*, and thus, a temperature increases, whereby the bimetal 62 is bent in one direction.

Due to such a configuration, when a fault current is conducted, a current flows between the first terminal 66 and the second terminal 64, and the heater 64*b* generates heat with the current. The heater 64*b* heats the bimetal 62 with the generated heat. The heated bimetal 62 is bent in a right direction in FIG. 2. The bent bimetal 62 rotates the crossbar 42 by using the pressure member 62*a* to bind a latch (not shown) of the switching mechanism 40 and release the binding of the latch. When the binding of the latch (not shown) is released, the moving contact 30 is quickly detached from the fixed contact 20 by an elastic force of a trip spring (not shown) of the switching mechanism 40.

Here, the indirect trip device 60 uses a method in which the bimetal 62 does not directly generate heat, and the heater 64*b* that is the separate heat generating member generates heat to heat the bimetal 62. Therefore, the indirect trip device can prevent the bimetal 62 from being damaged by a fault current, and thus is applied to a circuit breaker for a high rated current.

FIG. 3 illustrates a direct trip device 60'. The direct trip device 60' includes a first terminal 66' which is connected to a power source circuit or a load circuit at one side of the first terminal 66' and is connected to one side of a bimetal 62' through a lead wire 66*c*' at the other side, a second terminal 64' which is connected to the power source circuit or the load circuit at one side of the second terminal 64' and is connected to the other side of the bimetal 62' at the other side, and the bimetal 62' which is coupled to the lead wire 66*c*' of the first terminal 66' at one side of the bimetal 62' and is connected to the second terminal 64' at the other side. When electricity is conducted, a current flows in the bimetal 62', and thus, the bimetal 62' directly generates heat, whereby the bimetal 62' is bent.

Due to such a configuration, when a fault current is conducted, a current flows from the second terminal 64' to the first terminal 66' through the bimetal 62'. At this time, the bimetal 62' directly generates heat. A temperature of the bimetal 62' increases due to the directly generated heat, and thus, the bimetal 62' is be bent in a right direction in FIG. 3. The bent bimetal 62' rotates the crossbar 42 by using a pressure member 62*a*' to bind the latch (not shown) of the switching mechanism 40 and release the binding of the latch. When the binding of the latch (not shown) is released, the moving contact 30 is quickly detached from the fixed contact 20 by an elastic force of the trip spring (not shown) of the switching mechanism 40.

Here, the direct trip device 60' uses a method in which a current flows in the bimetal 62', and thus, the bimetal 62' directly generates heat. Therefore, despite a low rated current, the direct trip device 60' generates a large amount of heat, and thus is applied to a circuit breaker for a low rated current.

However, an amount of heat generated by the related art indirect trip device 60 for a circuit breaker is insufficient under a low rated current, and thus, a bending amount of the bimetal 62 is insufficient. For this reason, the related art indirect trip device 60 cannot detect a fault current. Also, in the related art direct trip device 60' for a circuit breaker, the bimetal 62' can be damaged by a fault current.

SUMMARY OF THE DISCLOSURE

Therefore, an aspect of the detailed description is to provide a trip device for a circuit breaker, which sufficiently obtains an heating amount and a bending amount of a bimetal, thereby effectively detecting a fault current.

Another aspect of the detailed description is to provide a trip device for a circuit breaker, which realizes a desired rated current of the circuit breaker in a limited design space.

To achieve these and other advantages and in accordance with the purpose of this specification, as embodied and broadly described herein, a trip device for a circuit breaker includes: a first terminal connected to a power source or a load; a second terminal connected to the load or the power source; a bimetal in which a slot with one side opened is formed at one end of the bimetal, the one end is divided into a first end portion and a second end portion, the first end portion is connected to the first terminal, and the second end portion is connected to the second terminal, wherein the bimetal generates heat with a current which flows between the first end portion and the second end portion, and a heating amount of the bimetal is changed based on a length of the slot.

The slot may be formed as a long hole which extends in one direction.

The length of the slot may be formed as a length in which the bimetal generates heat by a predetermined amount of heat under a specific current value.

As the length of the slot increases, the heating amount of the bimetal may increase under the specific current value.

The bimetal may be formed to be symmetric with respect to the slot.

The first terminal may include a heater configured to generate heat to heat the bimetal when a current flows.

The heater may include a directly heating portion contacted with the bimetal to heat the bimetal through conduction The heater may include a radiant heating portion separated from the bimetal to heat the bimetal through convection or radiation.

The heater may include: a directly heating portion contacted with the bimetal to heat the bimetal through conduction; and a radiant heating portion separated from the bimetal to heat the bimetal through convection or radiation.

The first terminal may include a lead wire connected to the power source or the load at one end of the lead wire, and connected to the first end portion at the other end of the lead wire.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, embodiments of the present invention will be described in detail with reference to the accompanying drawings.

Figure 1:
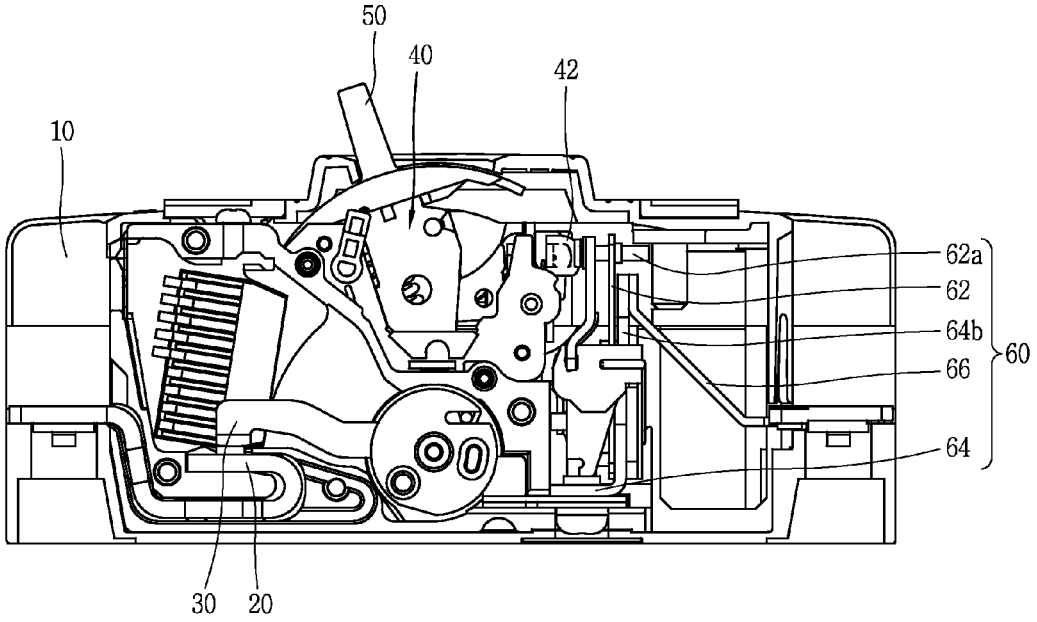
FIG. 1 RELATED ART
FIG. 1 is a cross-sectional view illustrating a related art circuit breaker.
Figure 2:
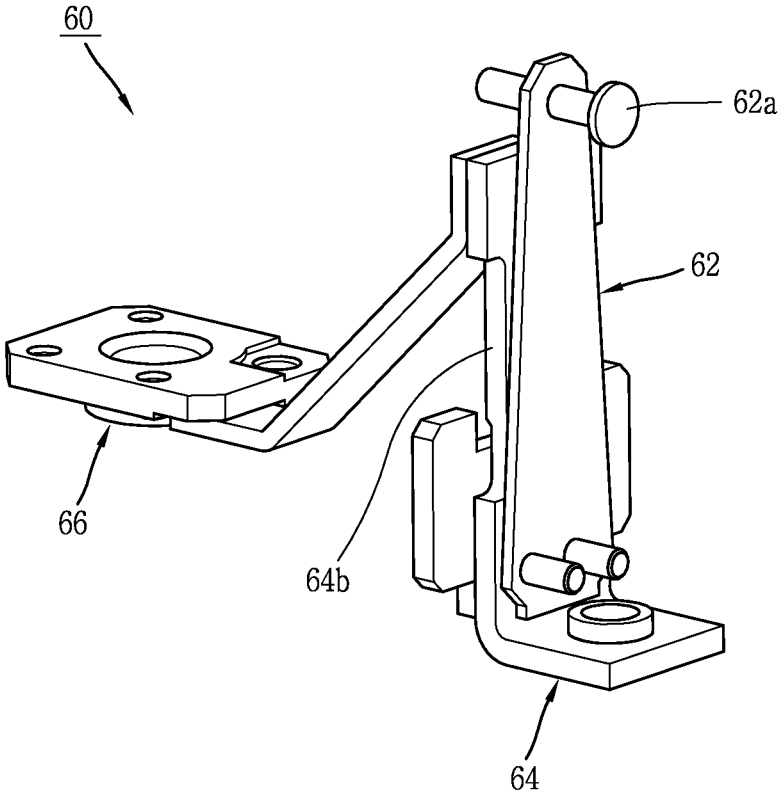
FIG. 2 RELATED ART
FIG. 2 is a perspective view illustrating an indirect trip device of FIG. 1.
Figure 3:
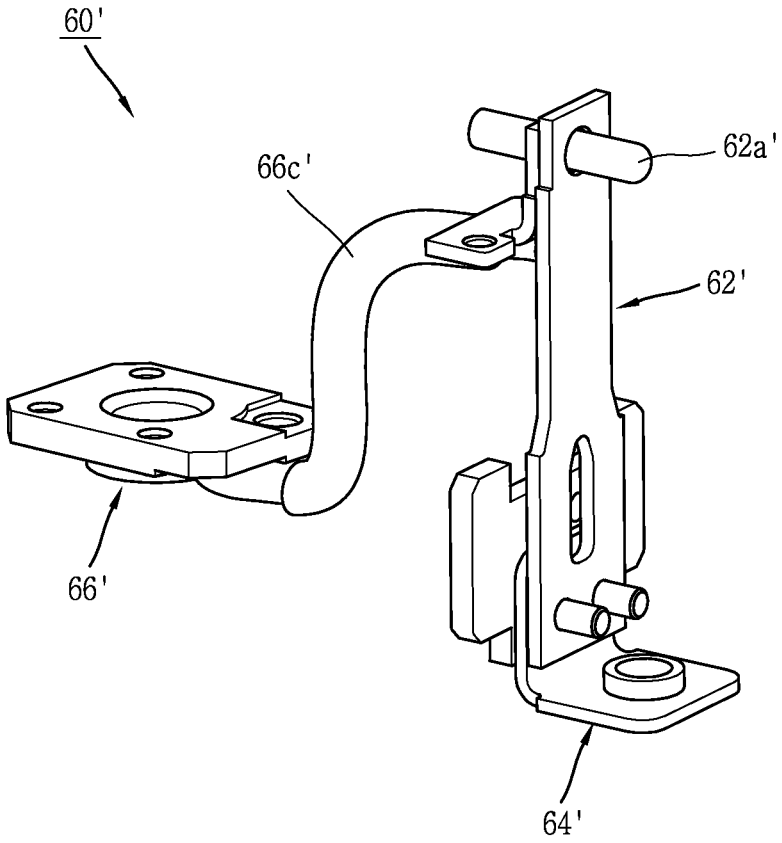
FIG. 3 RELATED ART
FIG. 3 is a perspective view illustrating a related art direct trip device for a circuit breaker.
Figure 4:
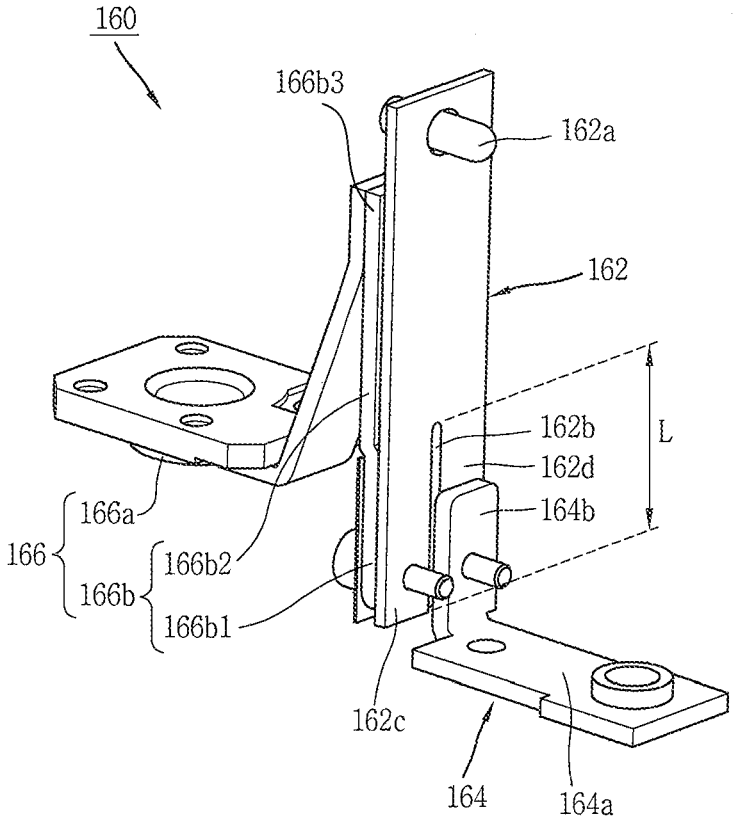
FIG. 4 is a perspective view illustrating a trip device according to a first embodiment of the present invention.
Figure 5:
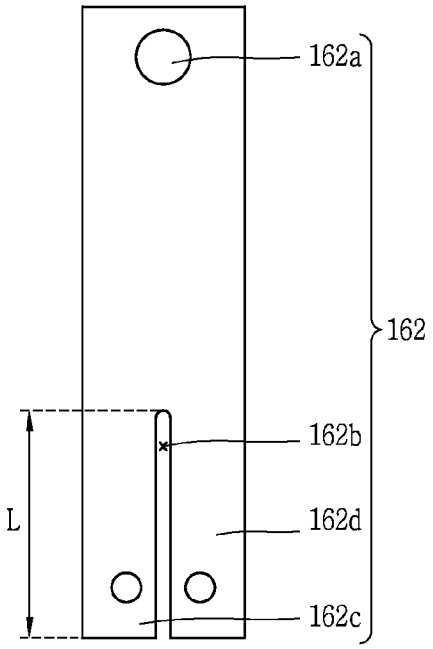
FIG. 5 is a front view illustrating a bimetal of FIG. 4.
Figure 6:
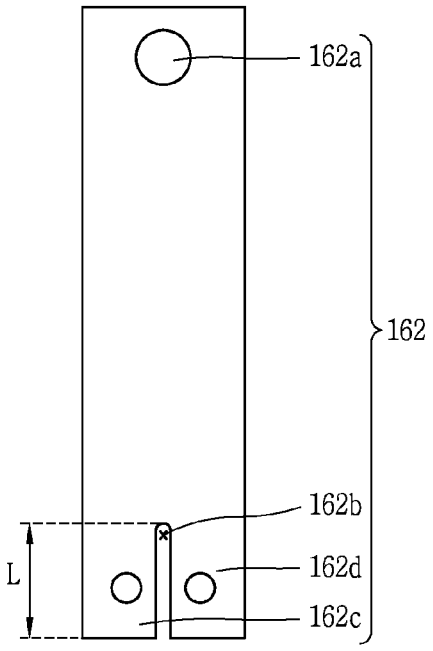
FIG. 6 is a front view illustrating a case in which a length of a slot of FIG. 5 is short.
Figure 7:
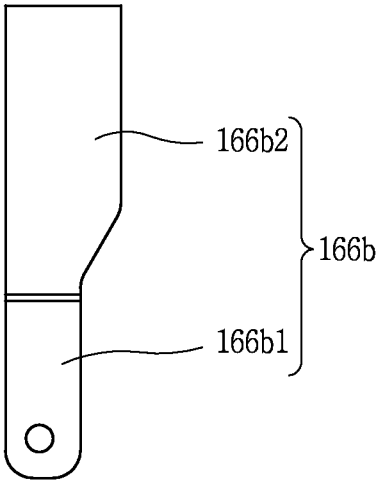
FIG. 7 is a front view illustrating a heater of FIG. 4.
Figure 8:
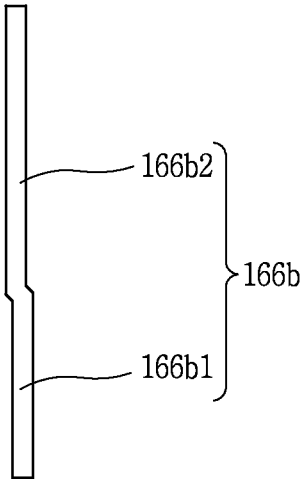
FIG. 8 is a side view of FIG. 7.
Figure 9:
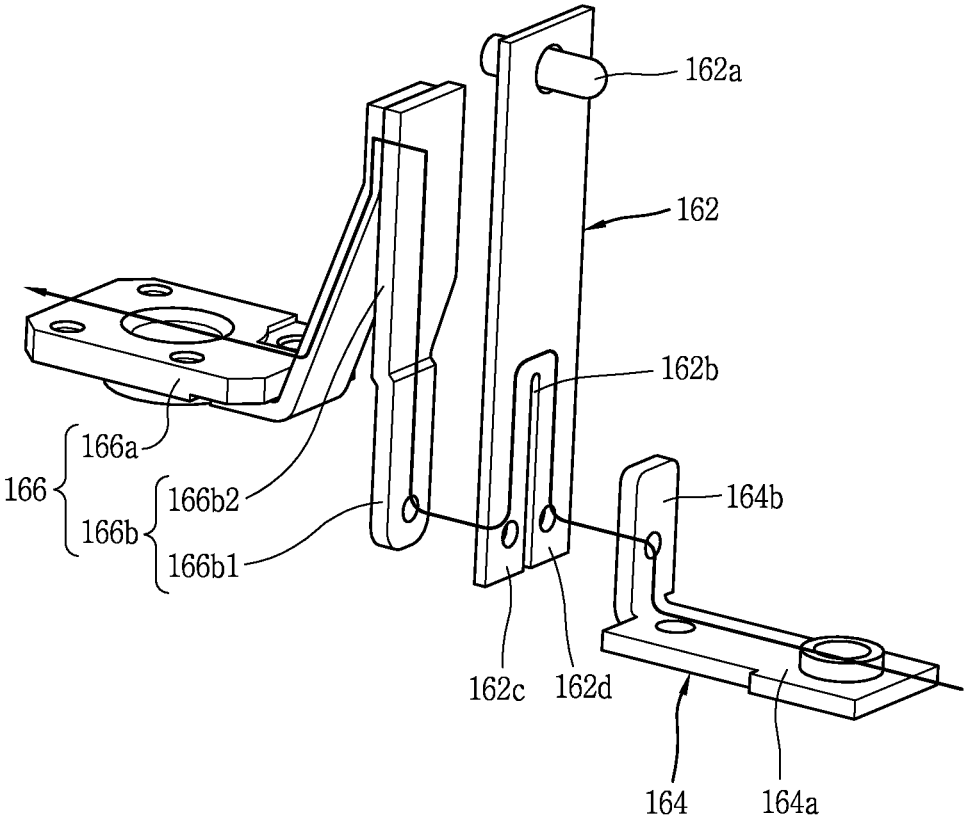
FIG. 9 is a perspective view illustrating a current flow direction of FIG. 4.

FIG. 4 is a perspective view illustrating a trip device according to a first embodiment of the present invention. FIG. 5 is a front view illustrating a bimetal of FIG. 4. FIG. 6 is a front view illustrating a case in which a length of a slot of FIG. 5 is short. FIG. 7 is a front view illustrating a heater of FIG. 4. FIG. 8 is a side view of FIG. 7. FIG. 9 is a perspective view illustrating a current flow direction of FIG. 4.

As illustrated in FIGS. 4 to 9, a trip device 160 for a circuit breaker according to a first embodiment of the present invention may include: a bimetal 162 in which a slot 162*b* with one side opened is formed at one end of the bimetal 162, and the one end is divided into a first end portion 162*c* and a second end portion 162*d*; a first terminal 166 which is connected to the first end portion 162*c* and is connected to a power source circuit or a load circuit; and a second terminal 164 which is connected to the second end portion 162*d* and is connected to the power source circuit or the load circuit.

The bimetal 162 may be a member that is bent in one direction when a temperature increases. The one end of the bimetal 162 may be coupled to the first terminal 166 and the second terminal 164, and thus, the bimetal 162 may be fixed. The slot 162*b* with the one side opened is formed at the one end of the bimetal 162, and thus, the one end may be divided into the first end portion 162*c* and the second end portion 162*d*. A pressure member 162*a* may be provided at the other end of the bimetal 162. Therefore, when a temperature increases, the bimetal 162 may be bent to rotate a crossbar 42 through the pressure member 162*a*.

In the present embodiment, the slot 162*b* may be formed in a long hole shape with one side opened, and a length L (a distance from the opened one side to the other side) of the slot 162*b* may be long formed as in FIG. 5 or may be shortly formed as in FIG. 6, based on a rated current desired to design. However, when a shortest distance in which a current flows between the first end portion 162*c* and the second end portion 162*d* is adjusted, the slot 162*b* may be formed in various shapes such as a circular hole with one side opened.

Moreover, the bimetal 162 may be formed to be laterally symmetric with respect to the slot 162*b*, so as to easily adjust a rated current by increasing sensitivity to adjust the length L of the slot 162*b*. In other words, the bimetal 162 may be formed in order for the first end portion 162*c* to be symmetric with the second end portion 162*d*.

The first terminal 166 may include a first terminal portion 166*a*, which is connected to the power source circuit or the load circuit, and a heater 166*b* which is connected to the first terminal portion 166*a* at one side of the heater 166*b*, is coupled to the first end portion 162*c* of the bimetal 162 at the other side, and generates heat when a current flows.

The heater 166*b* may be provided as a heating member which is approximately rectangular in shape. The heater 166*b* may include a directly heating portion 166*b*1, which is coupled to the first end portion 162*c* of the bimetal 162 and contacts the bimetal 162, and a radiant heating portion 166*b*2 which is offset from the directly heating portion 166*b*1, separated from the bimetal 162, and connected to the first terminal portion 166*a*. That is, the heater 166*b* is coupled to the first terminal portion 166*a* via a first end portion 166*b*3 of the heater 166*b*, and the heater 166*b* is coupled to the first end portion 162*c* of the bimetal 162 via a second end portion of the heater that corresponds to the directly heating portion 166*b*1. The directly heating portion 166*b*1 may be one surface corresponding to a lower portion in the drawing, and the radiant heating portion 166*b*2 may be the other surface corresponding to an upper portion in the drawing.

In the present embodiment, the directly heating portion 166*b*1 may be provided at the lower portion of the heater 166*b*, and the radiant heating portion 166*b*2 may be provided at the upper portion of the heater 166*b*. Therefore, the directly heating portion 166*b*1 may be connected to the first end portion 162*c* of the bimetal 162, and may contact a lower portion of the bimetal 162. Also, the radiant heating portion 166*b*2 may be connected to the first terminal portion 166*a*, and may be separated from an upper portion of the bimetal 162. However, the heater 166*b* may be implemented according to various embodiments. For example, the directly heating portion 166*b*1 may be provided at an upper portion of the heater 166*b*, and the radiant heating portion 166*b*2 may be provided at a lower portion of the heater 166*b*. Therefore, the radiant heating portion 166*b*2 may be connected to the first end portion 162*c* of the bimetal 162, and may be separated from a lower portion of the bimetal 162. The directly heating portion 166*b*1 may be connected to the first terminal portion 166*a*, and may contact an upper portion of the bimetal 162. As another example, the directly heating portion 166*b*1 may be provided at a central portion of the heater 166*b*, and the radiant heating portion 166*b*2 may be provided at each of the upper portion and lower portion of the heater 166*b*. Therefore, the radiant heating portion 166*b*2 provided at the lower portion may be connected to the first end portion 162*c* of the bimetal 162, and may be separated from the lower portion of the bimetal 162. Furthermore, the directly heating portion 166*b*1 may contact a central portion of the bimetal 162. In addition, the radiant heating portion 166*b*2 provided at the upper portion may be connected to the first terminal portion 166*a*, and may be separated from the upper portion of the bimetal 162.

Moreover, in the present embodiment, the heater 166*b* may be provided in a heat receiving/radiation type where the heater 166*b* includes the directly heating portion 166*b*1 and the radiant heating portion 166*b*2. However, the heater 166*b* may be provided in another type. For example, the heater 166*b* may be provided in a heat receiving type where the heater 166*b* includes only the directly heating portion 166*b*1. That is, the heater 166*b* may be planarly disposed to wholly contact the bimetal 162, one side of the heater 166*b* may be connected to the first end portion 162*c* of the bimetal 162, and the other side may be connected to the first terminal portion 166*a*. As another example, the heater 166*b* may be provided in a heat radiation type where the heater 166*b* includes only the radiant heating portion 166*b*2. That is, the heater 166*b* may be wholly separated from the bimetal 162, the one side of the heater 166*b* may be connected to the first end portion 162*c* of the bimetal 162, and the other side may be connected to the first terminal portion 166*a*.

The second terminal 164 may act as a bracket that supports the bimetal 162, and connect the bimetal 62 to the load circuit or the power source circuit so as to enable electricity to be conducted. The second terminal 164 may include a second terminal portion 164*a*, which is connected to the load circuit or the power source circuit, and a coupling portion 164*b* which is approximately vertically formed to extend from the second terminal portion 164*a*, and is connected to the second end portion 162*d* of the bimetal 162.

Hereinafter, an operation and effects of the trip device 160 for a circuit breaker according to the first embodiment of the present invention will be described.

First, a current may flow from the second terminal portion 164*a* to the first terminal portion 166*a* via the coupling portion 164*b*, the second end portion 162*d*, the first end portion 162*c*, and the heater 166*b*. The bimetal 162 may directly generate heat with a current which flows from the second end portion 162*d* to the first end portion 162*c*. Also, the bimetal 162 may be heated by heat generated by the heater 166. That is, the bimetal 162 may be heated by the heat conduction of the directly heating portion 166*b*1, and may be heated by the convection or radiation of the radiant heating portion 166*b*2. For reference, as in the present embodiment, a type in which the bimetal 162 is directly heated and is indirectly heated by the heater 166*b* is referred to as a direct/indirect type. A temperature of the bimetal 162 may directly/indirectly increase, and thus, the bimetal 162 may be bent in a right direction in FIG. 4. Under a normal current, since an heating amount and a bending amount of the bimetal 162 are insufficient, the bimetal 162 may not trip a switching mechanism 40 of the circuit breaker. On the other hand, when a fault current such as a short circuit current occurs in a circuit, the heating amount and the bending amount of the bimetal 162 increase, and thus, the pressure member 162*a* may pressurize and rotate the crossbar 42. A latch (not shown) of the switching mechanism 40 may be bound by the rotation of the crossbar 42, and the binding of the latch may be released. When the binding of the latch is released, a moving contact 30 may be quickly detached from a fixed contact 20.

In such a process, the slot 162*b* may increase a distance in which a current flows from the second end portion 162*d* to the first end portion 162*c*. Therefore, a resistance value may increase, and the heating amount and the bending amount of the bimetal 162 may increase.

In this case, as illustrated in FIG. 5, the length L of the slot 162*b* may be long formed, and thus, the distance in which the current flows from the second end portion 162*d* to the first end portion 162*c* may increase. Therefore, the resistance value may increase, and the heating amount and the bending amount of the bimetal 162 may increase. On the other hand, as illustrated in FIG. 6, the length L of the slot 162*b* may be shortly formed, and thus, the distance in which the current flows from the second end portion 162*d* to the first end portion 162*c* may decrease. Therefore, the resistance value may decrease, and the heating amount and the bending amount of the bimetal 162 may decrease even under a high rated current. That is, the trip device 160 for a circuit breaker according to the present embodiment may adjust the length L of the slot 162*b* to adjust the distance in which the current flows from the second end portion 162*d* to the first end portion 162*c*, and thus adjust the resistance value and the heating amount and the bending amount of the bimetal 162, thereby setting a desired rated current.

For reference, in the present embodiment, the trip device 160 is implemented so that a current flows from the second end portion 162*d* to the first end portion 162*c*, but may be implemented so that a current flows from the first terminal portion 166*a* to the second terminal portion 164*a*.

Here, the trip device 160 for a circuit breaker according to the present embodiment may include: the bimetal 162 in which the slot 162*b* with the one side opened is formed at the one end of the bimetal 162, and the one end is divided into the first end portion 162*c* and the second end portion 162*d*; the first terminal 166 which is connected to the first end portion 162*c* and is connected to the power source circuit or the load circuit; and the second terminal 164 which is connected to the second end portion 162*d* and is connected to the power source circuit or the load circuit. In the trip device 160, the length L of the slot 162*b* may be adjusted, and thus, the distance in which the current flows from the second end portion 162*d* to the first end portion 162*c* may be adjusted. Therefore, the resistance value may be adjusted in a limited space, and the heating amount and the bending amount of the bimetal 162 may be adjusted, whereby a desired rated current may be set. That is, when the length L of the slot 162*b* is long formed, a distance in which a current flows between the first end portion 162*c* and the second end portion 162*d* may increase. Therefore, a resistance value may increase, and the heating amount and the bending amount of the bimetal 162 may increase. Accordingly, a circuit breaker having a low rated current specification, which obtains a sufficient amount of generated heat even under a low rated current and thus effectively detects a fault current, may be implemented. On the other hand, when the length L of the slot 162*b* is shortly formed, the distance in which a current flows between the first end portion 162*c* and the second end portion 162*d* may decrease. Therefore, the resistance value may decrease, and the heating amount and the bending amount of the bimetal 162 may decrease. Accordingly, a circuit breaker having a high rated current specification, which effectively detects the fault current without damaging the bimetal even under a high rated current, may be implemented. Furthermore, based on the length L of the slot 162*b*, a circuit breaker having a desired rated current specification may be implemented between the low rated current specification and the high rated current specification.

Moreover, in the trip device 160 for a circuit breaker according to the present embodiment, since the first terminal 166 includes the heater 166*b*, the bimetal 162 may generate heat with a current which flows between the first end portion 162*c* and the second end portion 162*d*, and moreover may be heated by the heater 166*b*, and thus, a temperature may increase. That is, a direct/indirect trip device may be implemented. Therefore, a circuit breaker which secures a sufficient amount of generated heat without damaging the bimetal and thus maximizes an effect of enhancing a reliability of an operation may be implemented.

Moreover, in the trip device 160 for a circuit breaker according to the present embodiment, the heater 166*b* may be provided in the heat receiving type. Therefore, a circuit breaker which maintains a function of preventing the bimetal from being damaged and is more suitable for a low rated current may be implemented.

Moreover, in the trip device 160 for a circuit breaker according to the present embodiment, the heater 166*b* may be provided in the heat radiation type. Therefore, a circuit breaker which more effectively prevents the bimetal from being damaged and thus is more suitable for a high rated current may be implemented.

Furthermore, in the trip device 160 for a circuit breaker according to the present embodiment, the heater 166*b* may be provided in the heat receiving/radiation type. Therefore, a circuit breaker in which a demerit of the heat receiving type and a demerit of the heat radiation type are remedied may be implemented.

Figure 10:
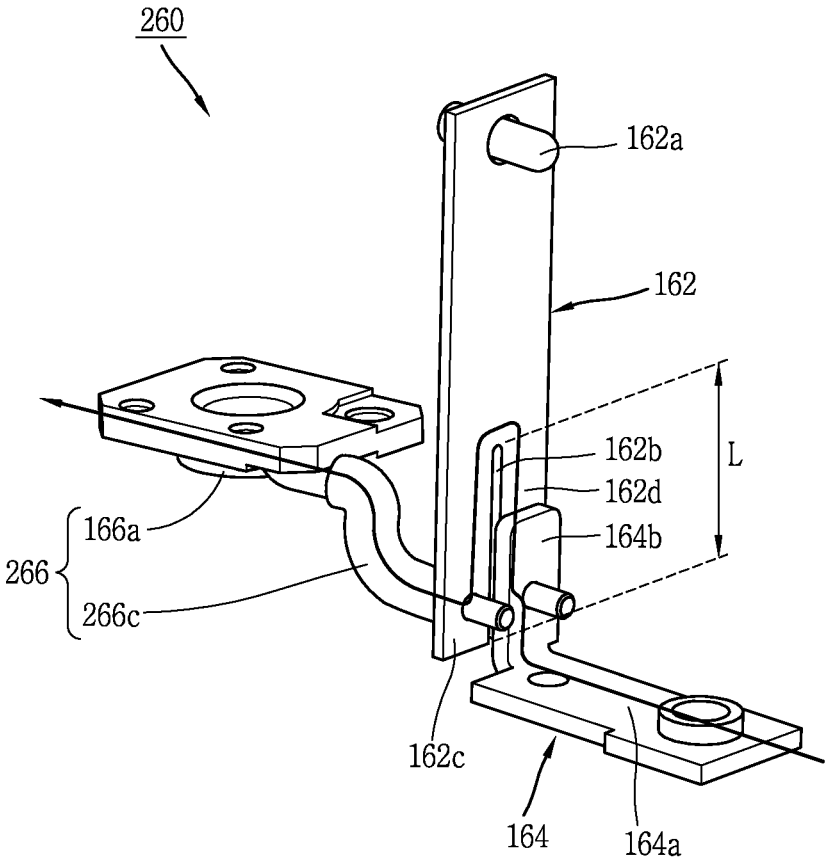
FIG. 10 is a perspective view illustrating a trip device according to a second embodiment of the present invention.

FIG. 10 is a perspective view illustrating a trip device according to a second embodiment of the present invention.

Hereinafter, a trip device 260 for a circuit breaker according to the second embodiment of the present invention will be described in detail with reference to FIG. 10.

The same elements as those of the trip device 160 according to the first embodiment are referred to by like reference numerals, and for convenience, repetitive descriptions on some elements may not be provided.

Unlike the above-described first embodiment, the trip device 260 according to the present embodiment may include a lead wire 266*c* instead of the heater 166*b*.

The trip device 260 according to the present embodiment may include: a bimetal 162 in which a slot 162*b* with one side opened is formed at one end of the bimetal 162, and the one end is divided into a first end portion 162*c* and a second end portion 162*d*; a first terminal 266 which is connected to the first end portion 162*c* and is connected to a power source circuit or a load circuit; and a second terminal 164 which is connected to the second end portion 162*d* and is connected to the power source circuit or the load circuit.

The first terminal 266 may include a first terminal portion 166*a*, which is connected to the power source circuit or the load circuit, and the lead wire 266*c* which is connected to the first terminal portion 166*a* at one side of the lead wire 266*c*, and is connected to the first end portion 162*c* of the bimetal 162 at the other side.

The lead wire 266*c* may connect the first terminal portion 166*a* to the first end portion 162*c* so as to enable electricity to be conducted.

Hereinafter, an operation and effects of the trip device 260 for a circuit breaker according to the second embodiment of the present invention will be described.

First, a current may flow from the second terminal portion 164*a* to the first terminal portion 166*a* via the coupling portion 164*b*, the second end portion 162*d*, the first end portion 162*c*, and the lead wire 266*c*. The bimetal 162 may directly generate heat with a current which flows from the second end portion 162*d* to the first end portion 162*c*. For reference, as in the present embodiment, a type in which the bimetal 162 directly generates heat is referred to as a direct type. A temperature of the bimetal 162 may increase in the direct type, and thus, the bimetal 162 may be bent in a right direction in FIG. 10. Under a normal current, since an heating amount and a bending amount of the bimetal 162 are insufficient, the bimetal 162 may not trip the switching mechanism 40 of the circuit breaker. On the other hand, when a fault current such as a short circuit current occurs in a circuit, the heating amount and the bending amount of the bimetal 162 increase, and thus, the pressure member 162*a* may pressurize and rotate the crossbar 42. The latch (not shown) of the switching mechanism 40 may be bound by the rotation of the crossbar 42, and the binding of the latch may be released. When the binding of the latch is released, the moving contact 30 may be quickly detached from the fixed contact 20.

Here, the trip device 260 for a circuit breaker according to the present embodiment may include: the bimetal 162 in which the slot 162*b* with the one side opened is formed at the one end of the bimetal 162, and the one end is divided into the first end portion 162*c* and the second end portion 162*d*;

the first terminal 166 which is connected to the first end portion 162*c* and is connected to the power source circuit or the load circuit; and the second terminal 164 which is connected to the second end portion 162*d* and is connected to the power source circuit or the load circuit. In the trip device 260, a length L of the slot 162*b* may be adjusted, and thus, a distance in which the current flows from the second end portion 162*d* to the first end portion 162*c* may be adjusted. Therefore, a resistance value may be adjusted in a limited space, and a heating amount and a bending amount of the bimetal 162 may be adjusted, whereby a desired rated current may be set. That is, when the length L of the slot 162*b* is long formed, a distance in which a current flows between the first end portion 162*c* and the second end portion 162*d* may increase. Therefore, the resistance value may increase, and the heating amount and the bending amount of the bimetal 162 may increase. Accordingly, a circuit breaker having a low rated current specification, which obtains a sufficient amount of generated heat even under a low rated current and thus effectively detects a fault current, may be implemented. On the other hand, when the length L of the slot 162*b* is shortly formed, the distance in which a current flows between the first end portion 162*c* and the second end portion 162*d* may decrease. Therefore, the resistance value may decrease, and the heating amount and the bending amount of the bimetal 162 may decrease. Accordingly, a circuit breaker having a high rated current specification, which effectively detects the fault current without damaging the bimetal even under a high rated current, may be implemented. Furthermore, based on the length L of the slot 162*b*, a circuit breaker having a desired rated current specification may be implemented between the low rated current specification and the high rated current specification.

Moreover, in the trip device 260 for a circuit breaker according to the present embodiment, since the first terminal 266 includes the lead wire 266*c*, the bimetal 162 may generate heat with a current which flows between the first end portion 162*c* and the second end portion 162*d*, and thus, a temperature may increase. That is, a direct trip device may be implemented. Therefore, in comparison with the first embodiment, a simple and low-cost circuit breaker may be implemented.

Descriptions on shapes, connection relationship, and effects of the other elements (i.e., the bimetal 162, the slot 162*b*, and the second terminal 164) of the trip device 260 for a circuit breaker according to the second embodiment of the present invention are the same as or similar to the first embodiment, and thus are not provided.

Moreover, the other elements and effects of the circuit breaker instead of the trip device 160 (260) according to the embodiments of the present invention are the same as the related art, and thus are not described.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A trip device for a circuit breaker, the trip device comprising:

a first terminal;

a second terminal separated from the first terminal;

a bimetal in which a slot with one side opened is formed at one end of the bimetal, the one end is divided into a first end portion and a second end portion along the slot such that the slot is formed between the first end portion and the second end portion, and the second end portion is connected to the second terminal; and a heater positioned between the first terminal and the bimetal such that the first terminal and the bimetal are not in direct contact, wherein the heater is configured to generate heat to heat the bimetal when a current flows, wherein the bimetal generates the heat when the current flows between the first end portion and the second end portion, and a heating amount of the bimetal is changed based on a length of the slot, and wherein the heater is coupled to the first terminal via a first end portion of the heater, and the heater is coupled to the first end portion of the bimetal via a second end portion of the heater, wherein the heater comprises a directly heating portion that is in contact with the bimetal to heat the bimetal through conduction and a radiant heating portion separated from the bimetal to heat the bimetal through convection or radiation, wherein the directly heating portion is provided at a lower portion of the heater including the second end portion of the heater, and the radiant heating portion is provided at an upper portion of the heater including the first end portion of the heater, and wherein the directly heating portion is connected to the first end portion of the bimetal, and the radiant heating portion is connected to the first terminal.

2. The trip device of claim 1, wherein the slot is formed as a long hole which extends in one direction.

3. The trip device of claim 2, wherein the length of the slot is formed as a length in which the bimetal generates heat by a predetermined amount of heat under a specific current value.

4. The trip device of claim 3, wherein as the length of the slot increases, the heating amount of the bimetal increases under the specific current value.

5. The trip device of claim 1, wherein the bimetal is formed to be symmetric with respect to the slot.

6. The trip device of claim 1, wherein the first end portion and the second end portion are formed symmetrically.

7. The trip device of claim 1, wherein the radiant heating portion does not contact the bimetal.

8. The trip device of claim 1, wherein the bimetal and the heater are arranged in parallel such that the first end portion of the heater is proximate to the other end of the bimetal and the second end portion of the heater is proximate to the one end of the bimetal.

9. The trip device of claim 1, wherein the heater further comprises a slant portion that is located between the directly heating portion and the radiant heating portion.

* * * * *